US007028769B2

(12) United States Patent
Mullins

(10) Patent No.: US 7,028,769 B2
(45) Date of Patent: Apr. 18, 2006

(54) WELL BORE CLEANING AND TUBULAR CIRCULATING AND FLOW-BACK APPARATUS

(76) Inventor: Albert Augustus Mullins, 408 Caney St., Boling, TX (US) 77420

( * ) Notice: Subject to any disclaimer, the term of this patent is extended or adjusted under 35 U.S.C. 154(b) by 137 days.

(21) Appl. No.: 10/695,206

(22) Filed: Oct. 28, 2003

(65) Prior Publication Data

US 2004/0112588 A1 Jun. 17, 2004

Related U.S. Application Data

(60) Provisional application No. 60/432,418, filed on Dec. 12, 2002.

(51) Int. Cl.
*E21B 37/02* (2006.01)

(52) U.S. Cl. ..... 166/177.3; 166/311; 166/202

(58) Field of Classification Search ..... 166/311, 166/177.3, 185, 202
See application file for complete search history.

(56) References Cited

U.S. PATENT DOCUMENTS

| | | | | |
|---|---|---|---|---|
| 2,073,126 | A | 3/1937 | Sweet | |
| 2,512,801 | A | 6/1950 | Kinney et al. | |
| 2,782,860 | A | 2/1957 | Tausch et al. | |
| 2,959,224 | A | 11/1960 | Ault | |
| 3,500,933 | A | 3/1970 | Burba, Jr. et al. | |
| 3,760,878 | A | 9/1973 | Peevey | |
| 3,775,805 | A | 12/1973 | Mitchell et al. | |
| 3,958,651 | A | 5/1976 | Young | |
| 4,474,240 | A | 10/1984 | Oliver, Jr. et al. | |
| 4,630,691 | A | 12/1986 | Hooper | |
| 4,671,355 | A | 6/1987 | Strange | |
| 4,776,395 | A * | 10/1988 | Baker et al. | 166/185 |
| 4,892,145 | A | 1/1990 | Stafford | |
| 4,944,348 | A | 7/1990 | Whiteley et al. | |
| 5,030,291 | A | 7/1991 | Titmas | |
| 5,033,545 | A | 7/1991 | Sudol | |
| 5,069,286 | A | 12/1991 | Roensch et al. | |
| 5,269,384 | A | 12/1993 | Cherrington | |
| 5,318,128 | A | 6/1994 | Johnson et al. | |
| 5,402,850 | A | 4/1995 | Lalande et al. | |
| 5,419,397 | A | 5/1995 | Reynolds et al. | |
| 5,462,115 | A * | 10/1995 | Belden et al. | 166/177.3 |
| 5,562,159 | A | 10/1996 | Smith et al. | |
| 5,570,742 | A | 11/1996 | Reynolds et al. | |
| 5,718,289 | A | 2/1998 | Schnatzmeyer et al. | |
| 6,347,667 | B1 | 2/2002 | Howlett et al. | |
| 6,371,207 | B1 | 4/2002 | Reynolds | |
| 6,390,190 | B1 | 5/2002 | Mullins | |
| 6,415,862 | B1 | 7/2002 | Mullins | |
| 6,883,605 | B1 * | 4/2005 | Arceneaux et al. | 166/202 |
| 2004/0099413 | A1 * | 5/2004 | Arceneaux | 166/177.3 |

OTHER PUBLICATIONS

Baker Oil Tools, "Casing Wiper System," 2 pages, Jan. 1, 1995.

M-I LLC, A Smith/Schlumberjer Company, "The Speedwell Thistle Cementing Brush Plug: A cost-saving alternative for wellbore clean-outs," 19 page catalog, 2001.

* cited by examiner

*Primary Examiner*—David Bagnell
*Assistant Examiner*—Matthew J. Smith
(74) *Attorney, Agent, or Firm*—Steve Rosenblatt

(57) ABSTRACT

Several well bore clean-out apparatus' are disclosed that provides a method of cleaning a well bore while the apparatus' are being deployed into a well forcing well bore fluid into a work string and for moving solids to the surface. A method of cleaning multiple diameters of well casings is also disclosed. A method of circulating or reverse circulating the well at anytime during the deployment of the apparatus' is disclosed.

17 Claims, 7 Drawing Sheets

WELL BORE CLEANING AND TUBULAR CIRCULATING AND FLOW-BACK APPARATUS

PRIORITY INFORMATION

This application claims the benefit of U.S. Provisional Application No. 60/432,418 on Dec. 12, 2002.

FIELD OF THE INVENTION

The field of this invention relates to a method of cleaning a well bore with a tubular wiper and valve arrangement.

BACKGROUND OF THE INVENTION

During the process of drilling and completing a well it is often desirable to remove all solid materials from the mud system in the well bore as well as removal of cement, metal and other materials which may cling to the wall of the tubular or in the case of a deviated well be laying on the side or bottom of the partially horizontal tubular. In many cases it is also desirable to change out the mud system in the well bore to a completion fluid, which is free of solids.

Currently this process is accomplished by running a tubular (commonly called a "work string") to or near the bottom of the well. Then circulating fluid through or down this work string and into the annulus between the tubular and well bore. Circulation is accomplished by pumping fluid down the work string and back to the surface through the annulus between the work string and casing.

To assist in these process mechanical devices such as casing scrapers and brushes are attached near the bottom of the work string to remove the solids that may cling to the casing such as cement, formation debris or metal particles.

Circulation to remove the solids requires turbulent flow. In most if not all cases sufficient pump capacity is not available to accomplish the required flow rates. The flow area of the annulus is no less than 3 times and more often 5 to 10 times that of the work string. Therefore the flow rate required to maintain turbulent flow in the annulus is at least 3 times that required in the work string. By causing the solid laden fluid to flow to the surface through the work string the solids are more likely to be removed from the well due to the higher velocity fluid stream in the work string. This is particularly true in deviated wells where it is known that the mud system will "channel" and not cover the entire annular area. In these cases the solids remain in the well bore and can cause failure of packers, valves, etc. that are run in the well as a part of the completion process. These solids can also cause formation damage that prevents the well from producing at its maximum or prevents injection into the formation.

It is therefore evident to those familiar with these processes that it is desirable to move the solids to the surface by forcing them into the highest velocity flow available this being the work string.

The newest known device that represent this type of well bore clean out method is from Baker Oil Tools titled "The Well Bore Custodian" These devices are run and pulled from the well bore to remove the solids from the casing wall and place them in the mud system. Most devices require circulation to remove the solids; recognizing that circulation alone can not remove the solids, Bakers' device attempts to remove the solids by filtering them from the mud system. This device relies on the filtering system to retain the solids until the device is removed from the well. As seen in the prior art, filtering devices have been tried in the past and found not to remove all of the solids.

In the past, as illustrated in several patents, there have been a variety of tools and techniques used to remove debris. U.S. Pat. No. 2,782,860 shows the use of reverse circulation into a pickup tube held by a packer inside a tubular. Several devices involve pulling vacuum on the tubular to suck fluid and debris into it. Some examples are U.S. Pat. Nos. 3,775,805; 4,630,691; 5,269,384; 5,318,128; 3,958,651 and 5,033,545 (fluid jet creates a vacuum). U.S. Pat. No. 5,402,850 uses a seal and crossover to force fluid with debris into the annulus around the tubular string for the trip to the surface. Other techniques involve reverse flow into the tubing string, such as: U.S. Pat. Nos. 4,944,348 and 5,069,286. Also of interest are U.S. Pat. Nos. 5,562,159 and 5,718,289.

SUMMARY OF THE INVENTION

Multiple embodiments of well bore clean out systems are disclosed. These embodiments remove the solids from the well bore annulus as soon as they are encountered and places them into the tubular being run in the well bore. This will place the solids into the inside of the work string where higher velocities will move the solids to the surface where they can be separated from the mud system. This is made practical by newly patented devices such as those disclosed in patents U.S. Pat. Nos. 6,390,190 and 6,415,862.

The system consists of at least one circulator assembly having a port below a packer cup to divert fluid from the annulus into the work string as the work string is being lowered into the well bore. This system can consist of a circulator assembly for each casing size in the well being cleaned, in other words, multiple circulator devices on one work string with porting to control the flow of fluids.

Valve assemblies are also be disclosed which selectively open and/or close to direct flow either into the tubular or around the packer cup. This valve assembly provides a path for fluid around the packer cup when the work string and circulator is removed from the well.

A method comprises of directing the mud above any mechanical cleaning devices and through a port below the packer cup into the tubular immediately below the packer cup.

A valve assembly is disclosed that selectively opens the very bottom of the work string to allow reverse circulation to the bottom of the work string to thoroughly clean the well bore prior to removing any one of the assemblies from the well bore.

An arrangement of packer cups is disclosed that assures that annulus fluid between circulators in different casing strings will be directed into the work string. In addition, a process comprises removing solids from the fluid system and casing wall.

DETAILED DESCRIPTION OF THE PREFERRED EMBODIMENT

Figure 1:
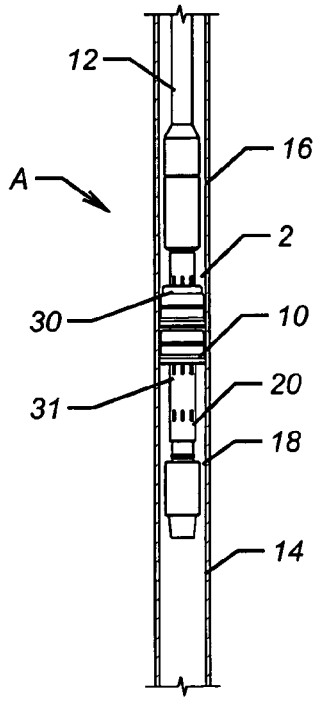
FIG. 1 is a sectional view of a well showing the apparatus positioned in a well having a single casing.

Referring to FIG. 1, an embodiment A is illustrated that mounts a seal 10 to the work string 12. Seal 10 can be any one of a variety of styles but a downwardly oriented cup seal is preferred. Not shown in FIG. 1 is the top end of the work string 12 that is connected to a device described in U.S. Pat. Nos. 3,390,190 or 6,415,862 or another surface mounted device that can connect the top of the work string 12 to separation equipment so the debris can be removed prior to the fluid returning to the mud pit. While the seal 10 is advanced downhole, it cleans the debris from the inner wall 14 of the casing 16. Fluid in the annular space 18 below seal 10 is forced into the work string 12, through ports 20. Any suspended debris or debris scraped from the inner wall 14 goes into the work string 12 as a result of advancement of seal 10. Annulus 2 above seal 10 can have fluid added into it to compensate for the downhole movement of seal 10 and to prevent high pressure from forming across seal 10, which could retard the further advance of the apparatus A. The displaced fluid and debris that gets into the work string 12 will be directed through a connection apparatus of the type described in U.S. Pat. Nos. 6,390,190 or 6,415,862 or another device into surface separation equipment of known design (not shown) so that the screened fluid can be returned to the mud pit for future use.

Also shown are ports 30 and 31, which can be selectively opened or closed with ports 20 or conversely closed or opened to allow circulation or reverse circulation around seal 10 at any time during the deployment of apparatus A. The importance and operation of these ports will be more fully described later.

Not illustrated are mechanical devices such as brushes and casing scrapers which may be placed below apparatus A to facilitate removal of solids from the casing wall 14

Figure 2:
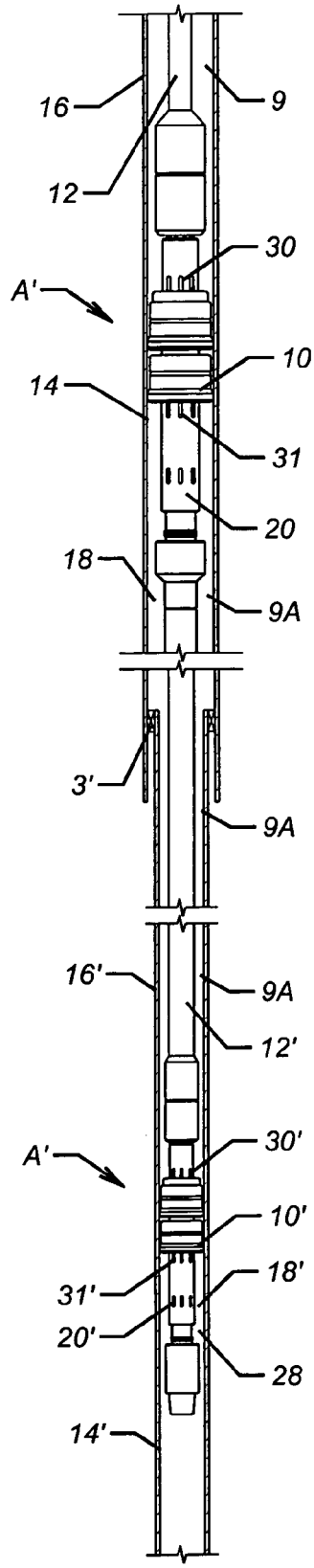
FIG. 2 is a sectional view of a well having a casing and liner of different sizes showing different sizes of the apparatus positioned in each of the casing string and liner.

FIG. 2 adds a second apparatus A' to the assembly shown in FIG. 1 for deployment in wells that have more than one casing size. Illustrated is apparatus A being deployed into casing 16 on work string 12 while apparatus A' is deployed into liner 16' on work string 12'. The transition from casing 16 to liner 16' is shown by use of a seal and anchor system 3 which is often a liner hanger.

Apparatus A will capture fluid and solids in annulus 18 while apparatus A' will capture fluid and solids in annulus 18'.

It is understood by those familiar with the art that apparatus A will be attached to a work string 12 which will be a length to position apparatus A near the liner hanger 3, while the length of the work string 12' will be sufficient to place apparatus A' near the depth of the liner 16'.

Also shown are ports 30, 30', 31 and 31', which can be selectively opened or closed with ports 20 and 20' or conversely closed or opened to allow circulation or reverse circulation around seals 10 and 10' at any time during the deployment of apparatus A and A'. The importance and operation of these ports will be more fully described later.

Again not illustrated are mechanical devices such as brushes and casing scrapers may be used below apparatus A and A' to facilitate removal of solids from the casing walls 14 and 14'.

Figure 3:
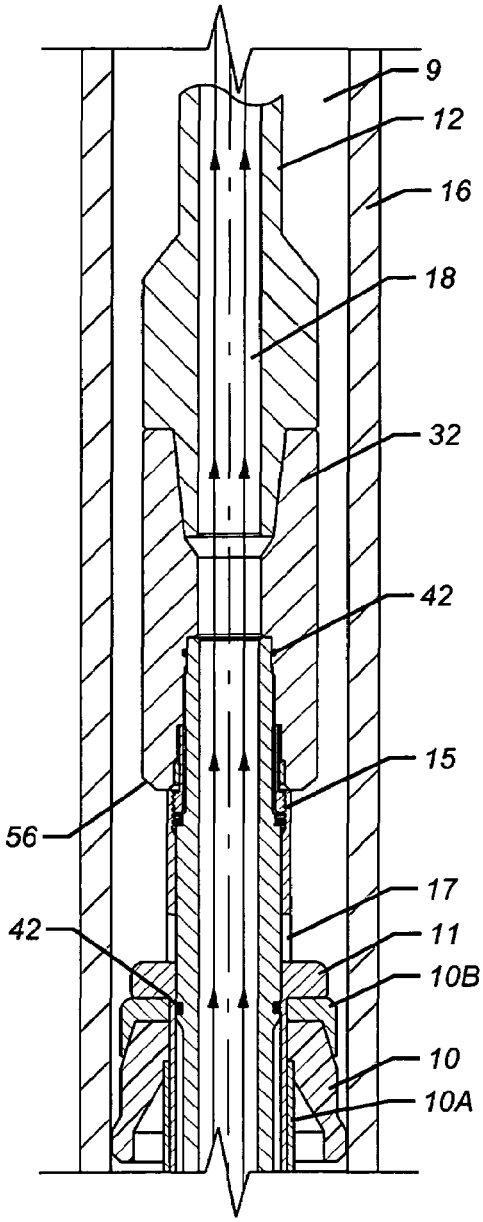
FIGS. 3 and 3A are a sectional view of a mechanically operated apparatus being run into a well showing the port opened and a cup seal to force the fluid in the annulus into the inside of the apparatus. This view also shows a plug in the lower end of the apparatus to force all fluid in the well below the apparatus into the inside of the apparatus.
Figure 3A:
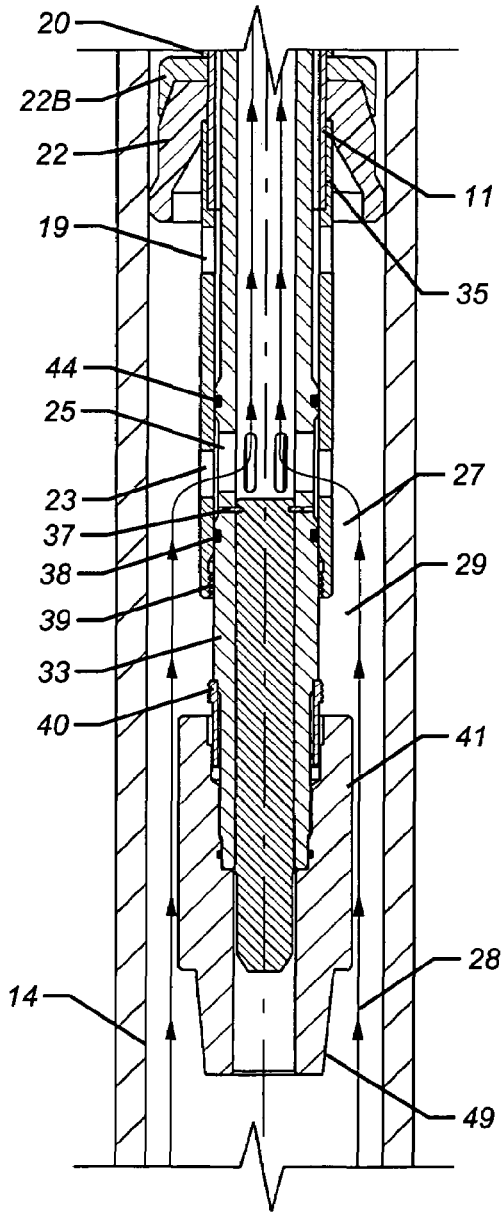

FIGS. 3 and 3A show one of the preferred embodiments being run into the well casing 16. The top sub 32 of the apparatus is threaded to the work string 12. The top sub 32 is threaded to a mandrel 33, which runs through the apparatus and terminates in a threaded connection to the bottom sub 41. The top sub 32 and bottom sub 41 are sealed at the mandrel 33 connection with seals 42 and 45 respectively.

A sleeve 11 is threaded to sleeve 35. These sleeves have mounted on their exterior, cup seals 10 and 22, which are supported by thimbles 10B and 22B. Though both cup seals, in FIG. 2, are shown facing downward it is apparent either of these seals can be positioned so that at lease one is facing upward. This can be important if circulation around the exterior of the seals is not wanted or if the fluid pressure in the annulus above the seals is higher than the pressure of fluid below the seals.

These cup seals 10 and 22 are held firmly to the sleeves 11 and 35 by use of the threaded connection 54 between sleeves 11 and 35 so that rotation of mandrel 33 will not rotate sleeve 11 or 35. The cup seals 10 and 22 are also separated by use of a cup sleeve 10A.

Sleeves 11 and 35 are held in an upward position and prevented from rotating by frictional forces between the cups 10 and 22 and the casing wall 14. As the work string 12 is lowered the mandrel 33 will be urged downward with respect to the cups 10 and 22 until the sleeve 35 shoulders on the lower end 56 of the top sub 32.

Figure 6:
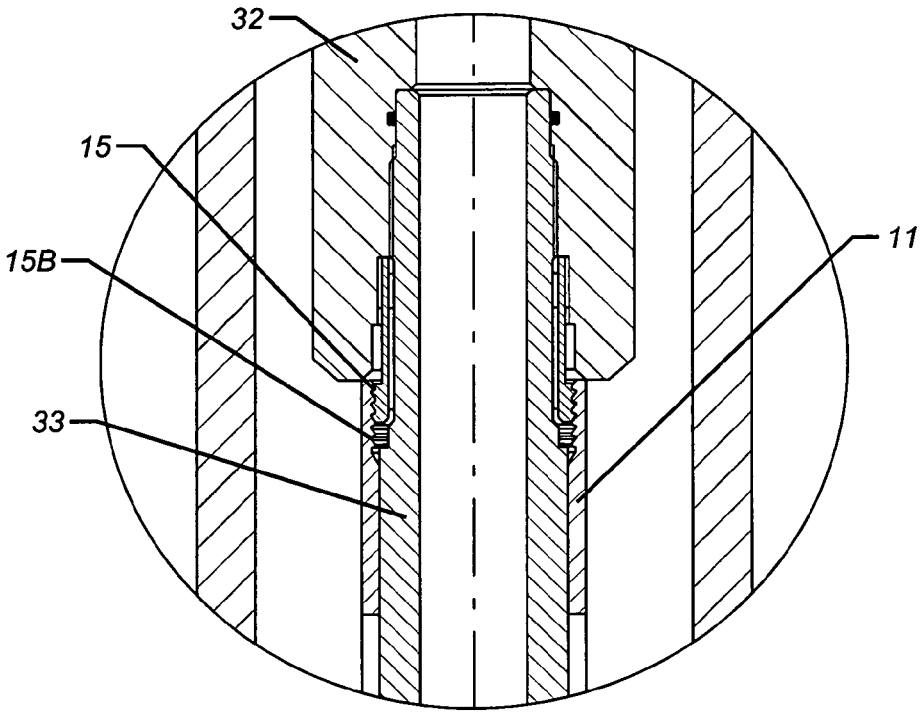
FIG. 6 is a partial sectional view showing detail of the upper latch shown in the apparatus in FIG. 3.
Figure 6A:
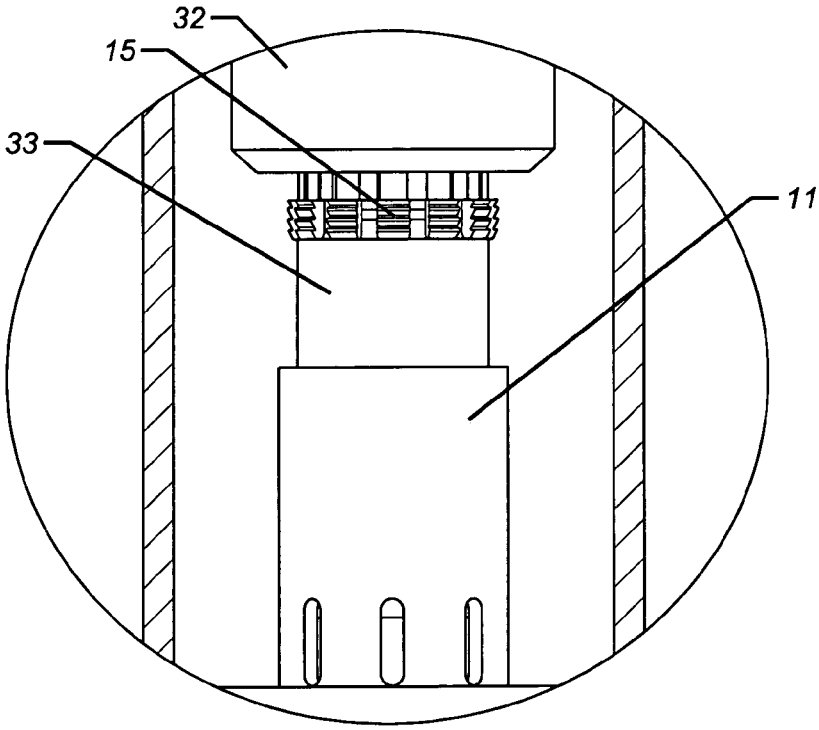
FIG. 6*a* is an external view of FIG. 6.

Should it be anticipated that fluids of a higher pressure may be above the upper cup (one of the cup seals will then be facing upward), the sleeves 11 and 35 may be held in this upward position by threaded fingers 58 on collet 15 (FIG. 6) which is mounded to the mandrel 33 and has threaded fingers 58 (FIG. 6A) engaged into the internal mating threads 15B (FIG. 6). Should there not be fluids of a higher pressure in the upper annulus there is no need to use the collet 15.

It is apparent to those familiar with the art that several apparatus may be run into a well on the same work string as indicated in FIG. 2. Each apparatus would have the same or similar porting arrangement as illustrated in FIGS. 3, 3A.

As the apparatus is being run into the casing 16 fluid and solids below the seal 22 flow into ports 23 of the sleeve 35 and into ports 25 in the mandrel 33 then to the interior of the mandrel 18 where they flow to the surface where they flow directly to the mud system or separator and filtering equipment (not shown). Seal 42 located on the mandrel 33 isolates ports 19 and 17. If this is the lowest apparatus in the work string as shown by apparatus A' in FIG. 1, fluid is prevented from entering the lower end of the apparatus by plug 29 which is sealed to the interior of the mandrel 33 at seal 27 and is held in position by shear screws 37 mounted between the plug 29 and mandrel 33. Plug 29 assures that all flow is through the ports 23 and 25 to maintain the highest velocity possible in annulus 34. This will prevent solids from collecting and plugging the annulus 34. This can be important where a casing scraper and or brushes (not shown) are used below the apparatus. The higher flow will help keep the solids moving through and around this equipment. Should this not be the lowest apparatus in the work string, plug 29 would not be used since flow from the lower apparatus' must move through the work string and all apparatus above and plug 29 would prevent this.

A collet 40 is also shown at the lower end of the mandrel 33 the purpose of which will be explained later.

Other devices such as scrapers, brushes, magnets, filters, plug catchers, work string, etc can be attached below the apparatus at threaded connection 49.

Figure 4:
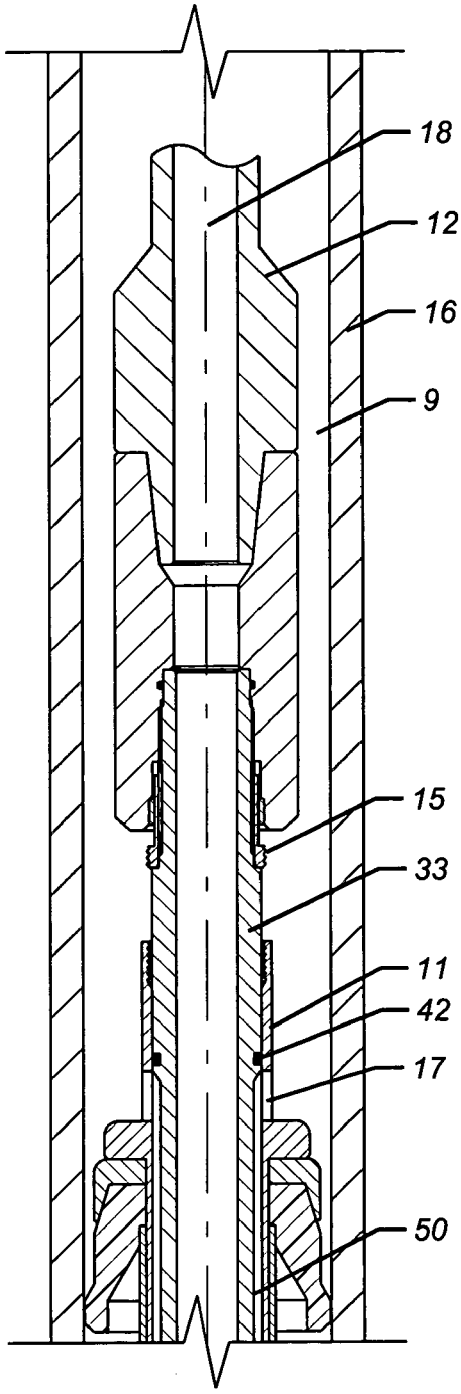
FIGS. 4 and 4A are a sectional view of the apparatus in FIG. 3 showing the port closed so that pressure may be applied to the inside of the apparatus to force the plug out of the apparatus.
Figure 4A:
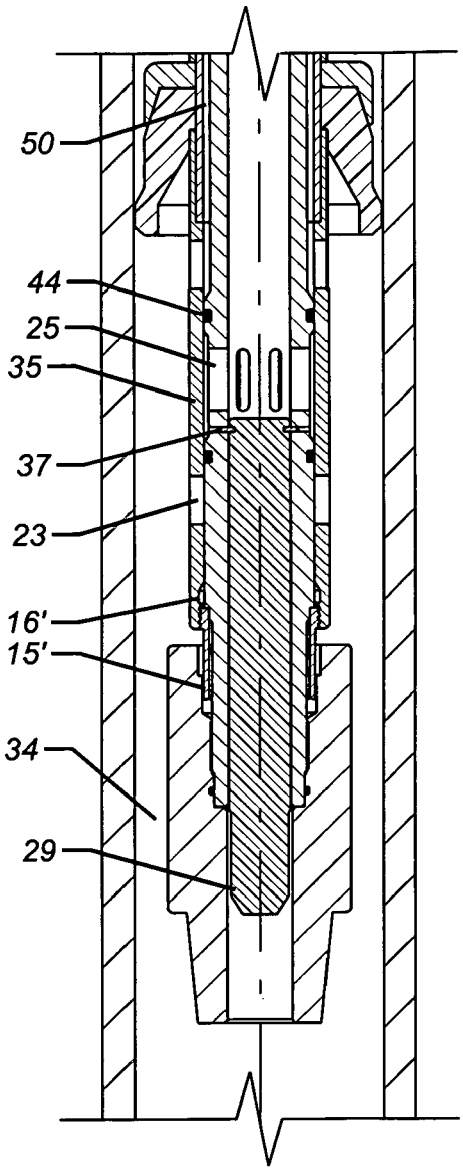
Figure 5:
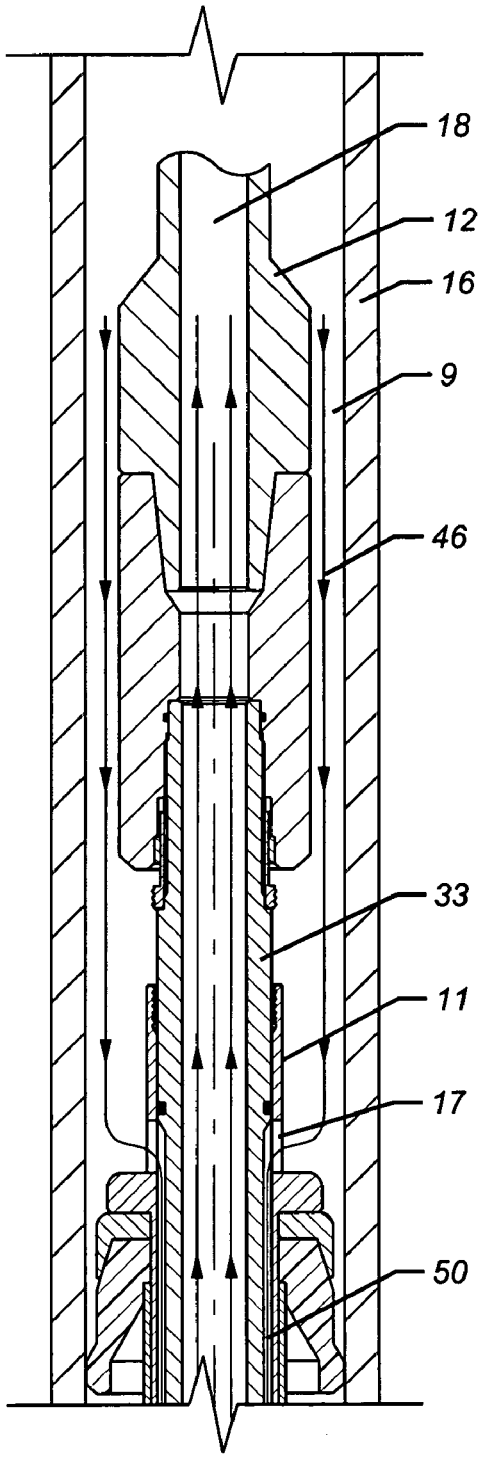
FIGS. 5 and 5A are a sectional view of the apparatus in FIG. 4 showing the port closed and a passage opened under the cup seal to allow communication of multiple annuli above and below the cup seal. This view also shows a plug in the lower end of the apparatus to force all fluid in the well below the apparatus into the inside of the apparatus.
Figure 5A:
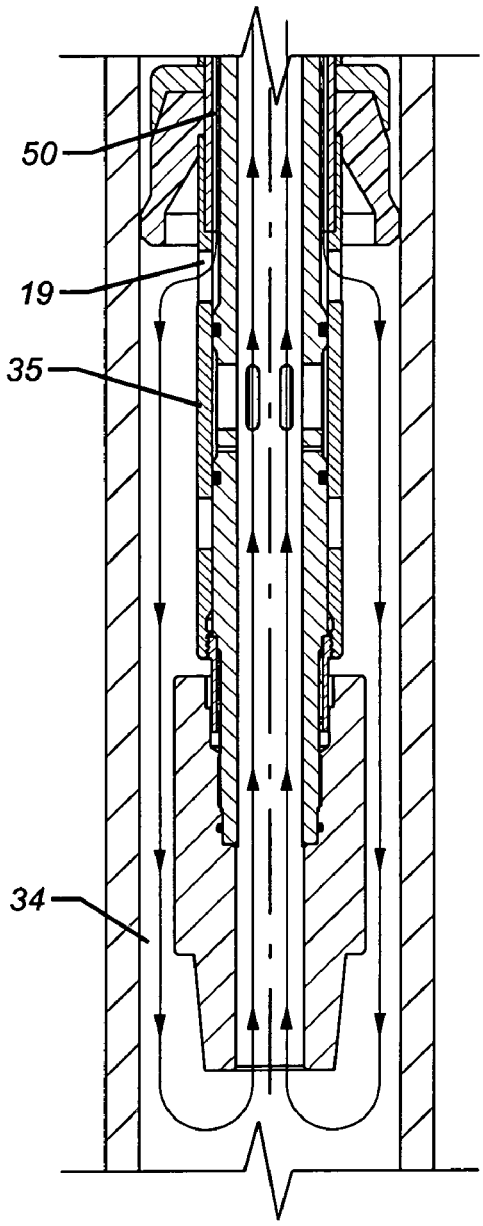

Referring now to FIGS. 4 and 4A, the apparatus is now shown as it would reach its lower most position in the well bore. At this time it would be desirable to reverse circulate the fluid that is in the work string to the surface since this fluid would contain solids swept from the well as the apparatus is deployed. Reverse circulation defined as moving fluid down the annulus 9 and up the inside of the tubular 18 as shown in FIGS. 5 and 5A.

To reverse circulate it is necessary to close the ports 23 and 25 and open port 17. This is accomplished by picking up on the work string 12 at the surface so that the mandrel 33 moves upward relative to sleeves 11 and 35. In this position seal 37 will isolate ports 25 from 23 closing them and port 17 moves below seal 42 thereby opening port 17. This will open an annular space 50 located between sleeves 11 and 35 and mandrel 33 forming a flow path between the upper annulus 9 and the lower annulus 34 to allow fluid above the apparatus to flow below the apparatus freely.

Should the latch 15 be used it would be necessary to rotate the work string 12 as it was being raised to unscrew latch 15 from the mating threads 16 (FIG. 6) in sleeve 11 to allow the mandrel 33 to move upward relative to sleeves 11 and 35. The same is true for latch 15' except that the work string is rotated as it is being lowered to unscrew latch 15' from mating threads 16' (FIGS. 4 and 4A) in sleeve 35.

It is apparent that latches 15 and 15' are not necessary for operation of the apparatus but serve the purpose of locking the apparatus in one of its two positions.

When the mandrel 33 moves upward until the bottom sub 41 contacts sleeve 35 latch 15' also engages mating latch threads 16' at the lower end of sleeve 35. This will hold sleeve 35 so that the tool remains in the reversing position. It is understood that the tool can be shifted back to the previous position by lowering the work string 12 while rotating to disengage the latch 15' from its mating threads 16'. This will close port 17 and open ports 23 and 25 and engage latch 15 with mating threads 16 as shown in FIG. 6.

To provide a flow path through the apparatus with ports 23 and 25 closed it is necessary to remove plug 29. Pressure can now be applied to the interior of the work string 12. This pressure will apply a force to plug 29 shearing screws 37 thereby releasing plug 29 from mandrel 33 and forcing plug 29 to the bottom of the work well or into a plug catcher sub located at the end of the tool assembly mounted below the apparatus, thus opening the work string.

Referring now to FIGS. 5 and 5A, the apparatus is now shown in the reverse circulating position. Fluid can now be pumped into annulus 46 (at the surface) through port 17, through the annular area 50 between mandrel 33 and sleeves 11 and 35, out port 19 through annulus 34 then into the interior of the tool string 18 back to the surface. Reverse circulating will completely flush all fluid from the well bore replacing it with fluid that is pumped into the annulus at the surface. Again it is understood that there can be other assemblies below the apparatus.

The arrangement of the sleeves 11 and 35 along with the friction of the cup seals 10 and 22 with the casing 16 provides a method of shifting the tool from the run in position to the reversing position at will.

In addition the use of the latches 15 and 15' with mating threads 16 and 16' in sleeves 11 and 35 provides a method of not only shifting from one position to the other but locking the apparatus in either of the positions at will.

Referring again to FIG. 2, should this be the upper assembly A in a tool string such that the fluid moving through the annulus 9, 9A and 28 will progress to the bottom assembly A' then into the interior of the work string 12.

Figure 7:
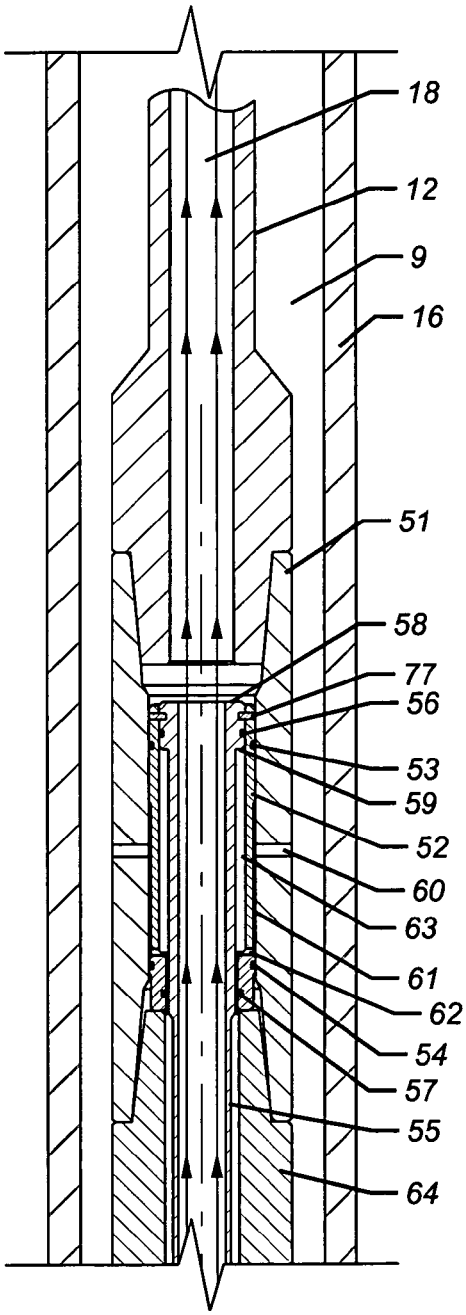
FIGS. 7 and 7A are a sectional view of a hydraulically operated apparatus being run into a well showing the port opened and a cup seal to force the fluid in the annulus into the inside of the apparatus. For simplicity, this view also shows the plug in the lower end of the apparatus removed.
Figure 7A:
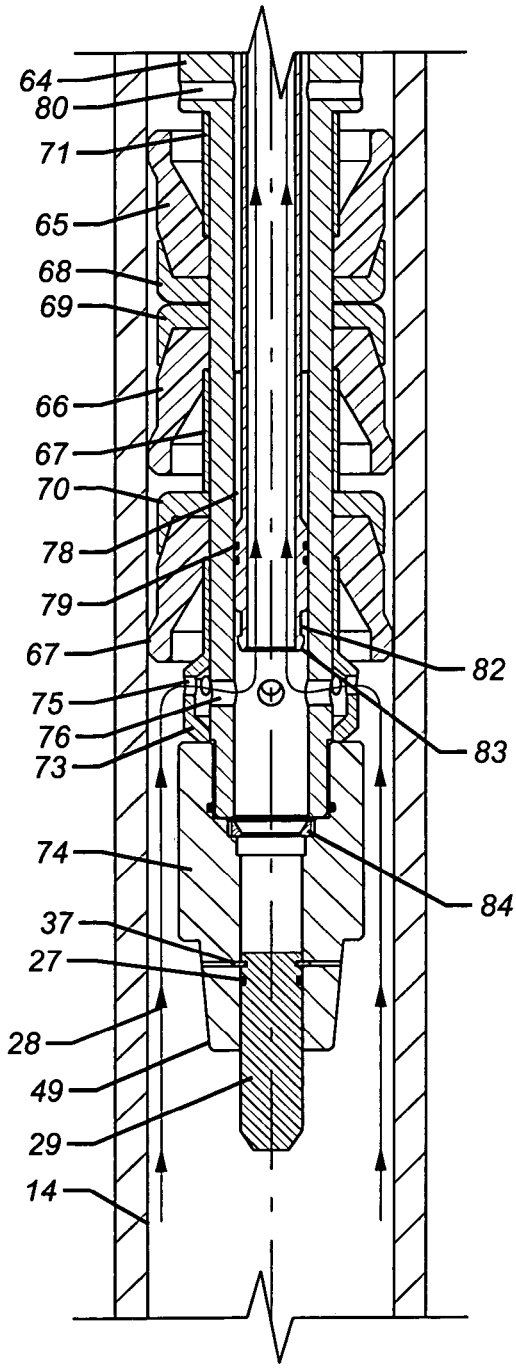

Referring now to FIGS. 7 and 7A, another embodiment is shown with a top sub 51 attached to the work string 12. Inside the top sub 51 is a sleeve 52 sealed in the top sub 51 by seals 53 and 54. A shifting sleeve 55 is located inside the sleeve 52 and is sealed in the sleeve 52 by seals 56 and 57. The shifting sleeve 55 is also secured to the sleeve 52 and by shear screws 77. Annulus pressure is vented through port 60 to an annular space 61 between top sub 51 and sleeve 52, this pressure is then vented to the annular space 63 through port 62 where it operates on surface 59 of shifting sleeve 55.

This upper portion of the apparatus forms a hydraulic system with pressure inside the work string 12 operating on the upper portion of the shifting sleeve 55 at surface 58 and pressure in the annulus 9 working on the lower side of the shifting sleeve at surface 59.

Top sub 51 is attached to mandrel 64. A number of cup seals 65,66, and 67 are mounted on mandrel 64 and supported by thimbles 68,69 and 70 and held in place by cup spacers 71 and 72 while being secured to the mandrel by cup sleeve 73. The cup seals, thimbles, cup spacers and cup sleeve components are secured by the bottom sub 74, which is connected to the lower end of the mandrel 51.

If this is the lower apparatus such as A' in FIG. 2 a plug 29 can be secured to the bottom sub 74 by shear screws 37. Seal 27 also seals the plug 29 inside the bottom sub 74.

Other devices such as scrapers, brushes, magnets, filters plug catcher subs etc can be attached below the apparatus at threaded connection 49.

As indicated by arrows 28, as this apparatus is lowered into the casing 16 by the work string 12 solids adhering to the casing wall 14 and fluids below the cup seals are directed into the work string 12 through ports 75 and 76 located in the cup sleeve 73 and mandrel 64. Fluid is prevented from entering annular space 78 located between mandrel 64 and shifting sleeve 55 by seals 79. Thus fluid is directed through the work string 12 to the surface where it can flow to the mud or filter system.

After reaching the desired depth, application of surface pressure to the interior of the work string 12 will first shear screws 27 forcing plug 29 out the bottom of the assembly to the bottom of the well or into a plug catcher sub (not shown) located at the end of all devices below the lowermost apparatus in the work string (this apparatus), secondly this pressure will shear screws 77 allowing shifting sleeve 55 to move downward until it contacts bottom sub 74. As this movement occurs seals 79 are moved below port 76 opening ports 75 and 76 to the annular space 78 between the mandrel 64 and shifting sleeve 55 thereby opening a path through port 80 to the annulus above the upper cup seal 65. Prior to the shifting sleeve 55 contacting the bottom sub 74 surface 83 of the shifting sleeve will open "C" ring 84. When shifting sleeve 55 contacts bottom sub 74 "C" ring 84 will snap into grove 82 of shifting sleeve 55. This "C" ring 84 will hold shifting sleeve in this position. With this arrangement the shifting sleeve once shifted cannot be returned to its original position.

Figure 8:
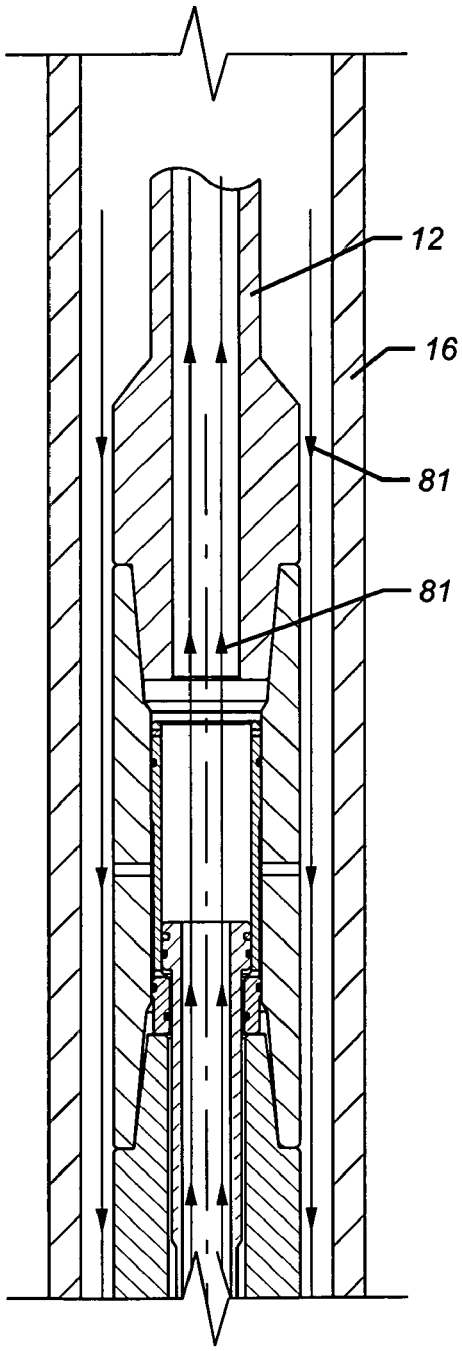
FIGS. 8 and 8A are a sectional view of the apparatus in FIG. 6 showing the port closed and a passage opened under the cup seal to allow communication of the annulus' above and below the cup seal.
Figure 8A:
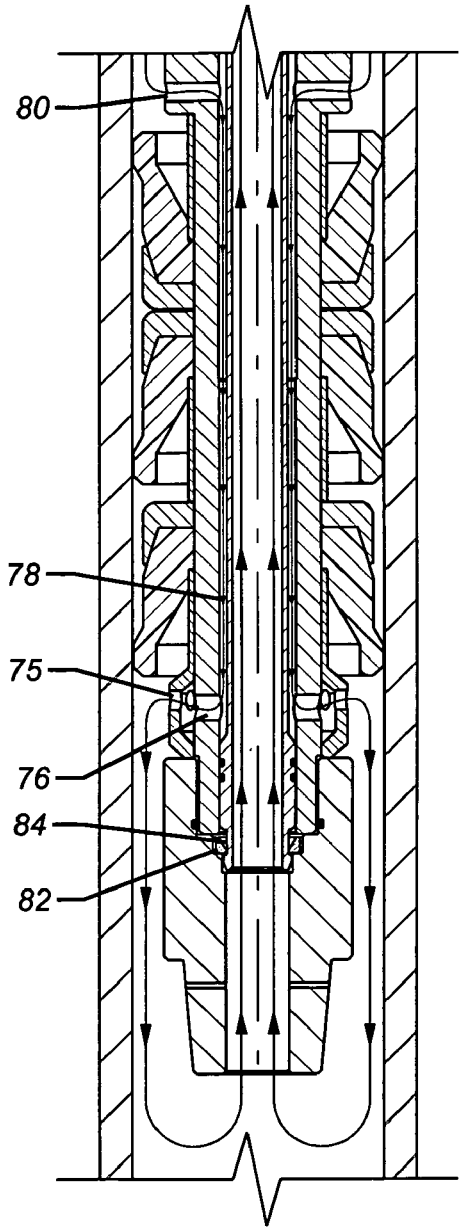

Now referring to FIGS. 8 and 8A, as shown by arrows 81 reverse circulation can now occur by pumping fluid into the annulus between the casing 16 and work string 12 at the surface. This fluid will then be directed through ports 80, annular spaces 78 and ports 75 and 76 of all such devices in the well to the lower most end of all devices where it will enter the interior of the work string 12 to be directed to the surface and back to the mud or filter system.

The foregoing disclosure and description of the invention are illustrative and explanatory thereof, and various changes in the size, shape and materials, as well as in the details of the illustrated construction, may be made without departing from the spirit of the invention.

I claim:

1. A wellbore cleaning apparatus, comprising:

a mandrel having a lower end extending beyond at least one lowermost fluid barrier, said lowermost fluid barrier extending toward the wellbore wall;

at least one first lateral opening through said mandrel, located between said lower end of said mandrel and said lowermost fluid barrier and substantially closer to said lowermost fluid barrier than to said lower end, said first lateral opening in fluid communication with an inner passage through said mandrel to accept fluid and debris as said mandrel is advanced downhole;

said inner passage extends through to said downhole end of said mandrel and is selectively closed;

said inner passage is selectively closed by a removable plug located between said lower end of said mandrel and first lateral opening;

said mandrel comprising a second passage extending from above to below said fluid barrier and selectively closed when said mandrel is advanced into the wellbore.

2. The apparatus of claim 1, wherein:

said second passage comprised an annular flowpath around said inner passage.

3. The apparatus of claim 2, wherein:

said lowermost fluid barrier is mounted on a sleeve fitted over said mandrel with at least one seal therebetween to define said annular flowpath.

4. The apparatus of claim 3, wherein:

said sleeve selectively blocks said first lateral opening to allow pressure in said inner passage to remove said plug.

5. The apparatus of claim 4, wherein:

said sleeve further movable with respect to said mandrel to open said annular flowpath while blocking said fist lateral opening on said mandrel.

6. The apparatus of claim 5, wherein:

said sleeve comprises a second lateral opening that substantially aligns with said first lateral opening on said mandrel when said mandrel is advanced into the wellbore.

7. The apparatus of claim 6, wherein:

said sleeve comprises a second lateral opening located above said lowermost fluid barrier and third lateral opening located below said lowermost fluid barrier, such that on withdrawal of said mandrel from the wellbore said second and third lateral openings provide access to said annular flowpath as said sleeve blocks said first lateral opening to allow fluid pumped through said annular passage to go externally of said mandrel to said lower end of said mandrel and into said inner passage.

8. The apparatus of claim 2, wherein:

said annular passage is defined by a piston movable between a first position where said first lateral opening is in fluid communication with said inner passage and said annular passage is closed to a second position where said annular passage is open and said first lateral opening is blocked.

9. The apparatus of claim 8, wherein:

said piston has a passage through it and is shifted by fluid flow through said passage running through it.

10. The apparatus of claim 9, wherein:

movement of said piston to block said first lateral passage allows pressure in said inner passage to blow out said plug as said annular passage, is opened, whereupon fluid can be forced from above said fluid barrier through said annular passage and below said fluid barrier and outside said mandrel to then enter the lower end of said mandrel in said inner passage from where said plug has been previously blown out.

11. The apparatus of claim 10, wherein:

said piston is selectively lockable in at least one of it said first and second positions; and said fluid barrier comprises a cup seal.

12. The apparatus of claim 3, wherein:

said mandrel moves with respect to said sleeve due to said fluid barrier supporting said sleeve from the wellbore.

13. The apparatus of claim 12, wherein:

said mandrel is movable with respect to said sleeve between a first position where said first lateral opening is unobstructed by said sleeve to a second position where said first lateral opening is obstructed by said sleeve and said annular passage is opened; said sleeve selectively locked to said mandrel in at least one of said first and said second positions.

14. The apparatus of claim 13, wherein:

said selective locking is defeated by rotation of said mandrel with respect to said sleeve.

15. A wellbore cleaning apparatus, comprising:

a mandrel having a lower end extending beyond at least one lowermost fluid barrier, said lowermost fluid barrier extending toward the wellbore wall;

at least one first lateral opening through said mandrel, located between said lower end of said mandrel and said lowermost fluid barrier and substantially closer to said lowermost fluid barrier than to said lower end, said first lateral opening in fluid communication with an inner passage through said mandrel to accept fluid and debris as said mandrel is advanced downhole;

said inner passage extends through to said downhole end of said mandrel and is selectively closed;

said inner passage is selectively closed by a removable plug located between said lower end of said mandrel and first lateral opening;

said lowermost fluid barrier comprises at least two barriers of different diameters disposed in at least two portions of the wellbore that have corresponding diameters to said barriers, said mandrel comprising a first lateral opening adjacent each barrier communicating with said through inner passage and said plug located between said lower end and said first lateral opening adjacent the smaller of said fluid barriers.

16. A wellbore cleaning apparatus, comprising:

a mandrel having a lower end extending beyond at least one lowermost fluid barrier, said lowermost fluid barrier extending toward the wellbore wall;

at least one first lateral opening through said mandrel, located between said lower end of said mandrel and said lowermost fluid barrier and substantially closer to said lowermost fluid barrier than to said lower end, said first lateral opening in fluid communication with an inner passage through said mandrel to accept fluid and debris as said mandrel is advanced downhole;

said inner passage extends through to said downhole end of said mandrel and is selectively closed;

said inner passage is selectively closed by a removable plug located between said lower end of said mandrel and first lateral opening;

said first lateral opening is selectively closed while a bypass passage from above to below said fluid barrier is opened to allow fluid to be forced from above to below said fluid barrier to flow outside said mandrel to said lower end thereof for return through said lower end of said passage with said plug removed.

17. The apparatus of claim 16, wherein:

said fluid barrier comprises a cup seal.

* * * * *